US009340324B2

(12) United States Patent
Plazarte

(10) Patent No.: US 9,340,324 B2
(45) Date of Patent: May 17, 2016

(54) VACUUM SEAL INDICATOR FOR FOOD PRESERVATION BAGS

(71) Applicant: Sunbeam Products, Inc., Boca Raton, FL (US)

(72) Inventor: Enrique Plazarte, Fort Lauderdale, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 2 days.

(21) Appl. No.: 14/483,390

(22) Filed: Sep. 11, 2014

(65) Prior Publication Data

US 2015/0071573 A1 Mar. 12, 2015

Related U.S. Application Data

(60) Provisional application No. 61/876,319, filed on Sep. 11, 2013.

(51) Int. Cl.

| | |
|---|---|
| ***B65D 33/00*** | (2006.01) |
| ***B65D 81/20*** | (2006.01) |
| ***B65D 79/00*** | (2006.01) |

(52) U.S. Cl.

CPC ..... *B65D 33/004* (2013.01); *B65D 79/005* (2013.01); *B65D 81/2023* (2013.01)

(58) Field of Classification Search

CPC ..... B65D 33/004; B65D 81/2038; B65D 77/225; B65D 33/01

USPC ..... 383/109, 105, 103, 100, 44; 206/524.8; 141/65, 7, 8; 116/270, DIG. 8, 266

See application file for complete search history.

(56) References Cited

U.S. PATENT DOCUMENTS

| | | | | |
|---|---|---|---|---|
| 2,130,180 | A | | 9/1938 | Evans |
| 3,152,711 | A | | 10/1964 | Mumford et al. |
| 3,241,514 | A | * | 3/1966 | Grimland ..... G01L 19/12 116/270 |
| 3,703,879 | A | | 11/1972 | Huthsing, Jr. |
| 3,736,899 | A | | 6/1973 | Manske |
| 4,295,566 | A | | 10/1981 | Vincek |
| 4,722,451 | A | | 2/1988 | Conrad |
| 4,877,143 | A | | 10/1989 | Travisano |
| 5,152,412 | A | | 10/1992 | Iler |

(Continued)

FOREIGN PATENT DOCUMENTS

| | | |
|---|---|---|
| JP | 05051039 | 3/1993 |
| WO | 2007038299 | 4/2007 |
| WO | 2010090483 | 8/2010 |

*Primary Examiner* — Christopher Demeree

(74) *Attorney, Agent, or Firm* — Michael J. Corrigan

(57) ABSTRACT

Sealable plastic bag with a vacuum indicator is comprised of first and second sheets, each formed of a thin flexible plastic membrane. At least one perforation is formed in the first sheet. An indicator is disposed on the first sheet over the at least one perforation. The indicator is comprised of a resilient material which forms a resilient convex protrusion on an external surface of the bag. The convex protrusion defines a chamber which is airtight except for the at least one perforation. A containment structure is associated with the perforation to inhibit migration of particles from the interior compartment into the chamber. The resilient material is responsive to an air pressure differential as between the interior compartment and an environment external of the interior compartment to collapse the convex protrusion under a predetermined pressure differential condition.

20 Claims, 8 Drawing Sheets

(56) References Cited

U.S. PATENT DOCUMENTS

| | | | | |
|---|---|---|---|---|
| 5,190,175 | A | 3/1993 | Schmidt | |
| 5,287,962 | A | 2/1994 | Nomi et al. | |
| 5,413,234 | A | 5/1995 | Hekal et al. | |
| 5,619,752 | A | 4/1997 | Haber et al. | |
| 5,893,461 | A * | 4/1999 | Walters | B65D 77/225 137/493 |
| 2003/0178066 | A1 | 9/2003 | Skeens et al. | |
| 2005/0161465 | A1 | 7/2005 | Miller et al. | |
| 2013/0330832 | A1 * | 12/2013 | Seegel | B29C 70/443 436/172 |

* cited by examiner

VACUUM SEAL INDICATOR FOR FOOD PRESERVATION BAGS

CROSS REFERENCE TO RELATED APPLICATIONS

This application claims the benefit of U.S. Provisional Patent Application Ser. No. 61/876,319 filed Sep. 11, 2013 which is herein incorporated by reference.

BACKGROUND OF THE INVENTION

1. Statement of the Technical Field

The inventive arrangements relate to food preservation bags, and more particularly to vacuum seal indicators for use in connection with such bags 2. Description of the Related Art Commercially available vacuum sealing systems are designed primarily for home usage by consumers who wish to extend the useful life of various foods. The vacuum sealing systems generally involve a vacuum sealer machine which evacuates the air from a bag in which food or other consumables have been disposed. Once the air has been removed, the vacuum sealing machine seals the bag to preserve freshness of foods contained therein.

The bags used in vacuum sealing systems can be comprised of high-density polyethylene, styrene based plastics or other types of plastic bags. The bags commonly consist of two opposing sheets of thin flexible plastic membrane. The two opposing sheets are often rectangular in shape to define four linear sides or edges. The two sheets are sealed around three of the four sides to form a bag-like structure with one open end which provides access to the interior of the bag. When the bag is to be sealed, food or other items are placed in the bag and the open end is positioned in a vacuum sealing machine. The vacuum sealing machine evacuates the air from the interior of the bag and forms a seal along the open end to enclose the contents of the bag. The most common approach to forming the seal involves heating the two opposing sheets along the open end of the bag to fuse the two sheets together along a seal line. For convenience of the user, some vacuum sealing systems are designed to make use of a continuous roll of tubular plastic sheeting from which plastic bags can be formed. The tubular plastic sheeting can be sealed at opposing ends to form a bag.

SUMMARY OF THE INVENTION

Embodiments of the invention concern a sealable plastic bag with a vacuum indicator. The sealable plastic bag is comprised of first and second sheets, each formed of a thin flexible plastic membrane. Each of the first and second sheets respectively has a substantially rectangular shape which defines four linear sheet edges. First, second and third seals are respectively formed along the length of three of the four linear sheet edges. The seals attach the first sheet directly to the second sheet to partially enclose an interior compartment of a bag and define an opening to the interior compartment between the first and second plastic sheets along the fourth linear sheet edge. At least one perforation formed in the first sheet. The perforation is spaced apart some distance from the opening and each of the first, second and third seals. An indicator is disposed on the first sheet over the at least one perforation. The indicator is comprised of a resilient material which forms a resilient convex protrusion on an external surface of the bag. The protrusion define a chamber which is airtight except for the at least one perforation. A containment structure is associated with the perforation to inhibit migration of particles from the interior compartment into the chamber. The resilient material is responsive to an air pressure differential as between the interior compartment and an environment external of the interior compartment to collapse the convex protrusion under a predetermined pressure differential condition. For example, the predetermined pressure differential can occur in the course of applying a vacuum pressure to the interior compartment as may occur in the course of a vacuum sealing procedure.

BRIEF DESCRIPTION OF THE DRAWINGS

Embodiments will be described with reference to the following drawing figures, in which like numerals represent like items throughout the figures, and in which.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

Figure 1:
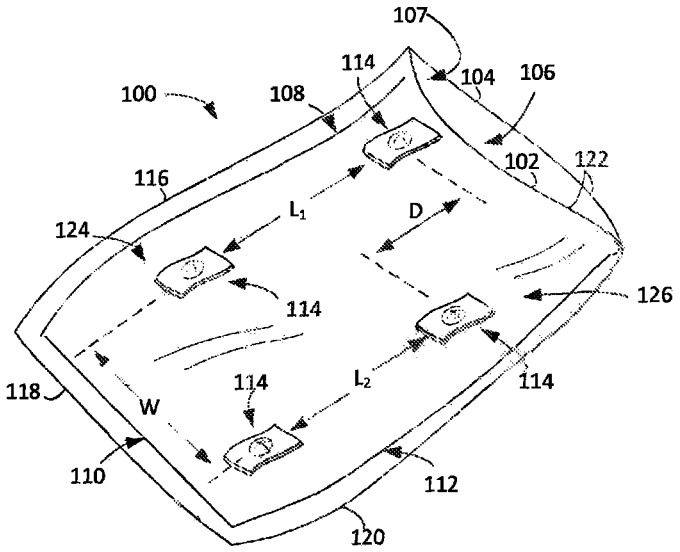
FIG. 1 shows an exemplary plastic bag with a vacuum seal indicator that is useful for understanding the invention.

Referring now to FIG. 1 there is shown an exemplary sealable plastic bag 100 with one or more vacuum seal indicators 114 that is useful for understanding the invention. The sealable plastic bag 100 is comprised of first and second sheets 102, 104, each formed of a thin flexible plastic membrane. In an exemplary embodiment, the plastic sheets can be comprised of high-density polyethylene, styrene based plastics or other types of plastic. In an exemplary arrangement, each of the first and second sheets respectively has a substantially rectangular shape which defines four linear sheet edges 116, 118, 120, 122. First, second and third seals 108, 110, 112 are respectively formed along the length of three of the four linear sheet edges. The seals attach the first sheet 102 directly to the second sheet 104 to partially enclose an interior compartment 106 of a bag and define an opening 107 to the interior compartment. Opening 107 is disposed between the first and second plastic sheets 102, 104 along the linear sheet edge 122.

Figure 2:
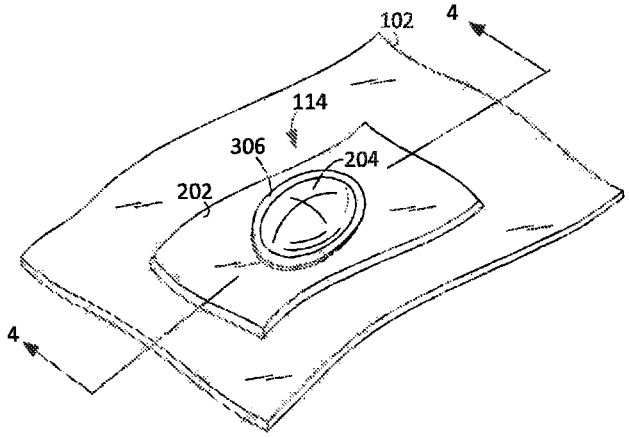
FIG. 2 is an enlarged view of an exemplary vacuum seal indicator which is useful for understanding the invention.

Referring now to FIG. 2 there is shown an enlarged view of an exemplary vacuum seal indicator 114 which is useful for understanding the invention. The vacuum seal indicator 114 is comprised of several parts which include a base 202, a convex protrusion 204, and a peripheral ring 306 formed at the lower edge of the convex protrusion. In some embodiments, one or more of the base 202 and peripheral ring 306 can be formed as a single integral unit with the convex protrusion 204 so that all three portions are formed of the same material. Still, the invention is not limited in this regard and in some embodiments the convex protrusion can be formed of a different material as compared to the base 202 and/or peripheral ring 306. In such a scenario, the convex protrusion and/or peripheral ring can be joined to the base by any suitable means, such as by adhesive or thermal bonding (not shown).

The convex protrusion is comprised of an elastomer or suitable rubber-like resilient material. For example, the convex protrusion can be formed of silicone rubber, nitrile rubber or butyl rubber. As such, the convex protrusion can be relatively soft and deformable, but will have a definite convex shape when not exposed to deforming forces. The peripheral ring and base can be integrally formed of the same elastomer material as the convex protrusion in some embodiments, but the invention is not limited in this regard. For example, the convex protrusion and peripheral ring could be integrally formed of an elastomer and the base could be formed of a planar polyester film material, such as Mylar®, which is then bonded to the peripheral ring as shown.

Figure 3:
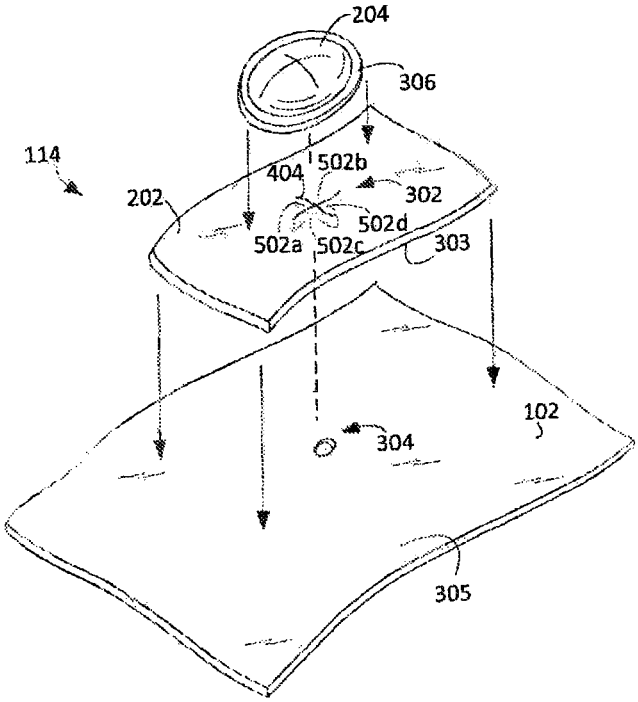
FIG. 3 is an exploded view showing a first embodiment of the vacuum seal indicator in FIG. 2.

Referring now to FIG. 3 there is shown an exploded view of a first embodiment of the vacuum seal indicator in FIG. 2 which is useful for understanding its arrangement and various features. It can be observed in FIG. 3 that there is provided at least one perforation 304 formed in the first sheet 102. The perforation is advantageously spaced apart some distance from the opening 107 and each of the first, second and third seals 108, 110, and 112. The vacuum seal indicator 114 is disposed on the first sheet 102, over the at least one perforation 304 as shown. The vacuum seal indicator is attached to the first sheet 102 so that the perforation 304 is generally aligned on center with the convex protrusion. A seal is formed around the periphery of the vacuum seal indicator where it is attached to the first sheet 102 to form a chamber 308 inside the convex protrusion (the chamber is best seen in FIGS. 4-7). For example, a seal (not shown) can be formed along a periphery of base 202. The seal can be formed by any suitable means, such as adhesive or thermal bonding. If adhesive is used, it can be disposed on an underside surface 303 of the base 202 to facilitate attachment of the vacuum seal indicator 114 on an upper surface 305 of the first sheet 102.

It is anticipated that the sealable plastic bag 100 may be used for stored contents comprising fresh food items or other items. Accordingly, a containment structure 302 is advantageously provided in association with the perforation 304 to inhibit migration of particles associated with the stored contents from the interior compartment 106 to the chamber 308. The containment structure is described below in further detail. However, it can be observed that the containment structure 302 comprises at least one flexible panel or flap 502*a*, 502*b*, 502*c*, 502*d* that is disposed adjacent to the at least one perforation 304 when the vacuum indicator 114 is attached to the first sheet 102. In FIGS. 4-7 two flexible panels 502*a*, 502*b* are shown on opposing sides of a slit. A single slit 404 can be used for this purpose but two or more crossed slits can also be used as shown in FIG. 3.

Referring now to FIGS. 4-7 there are shown a series of drawings comprising cross-sectional views of the first embodiment vacuum seal indicator in FIG. 3, taken along line 4-4 in FIG. 2. The convex protrusion 204 defines a chamber 308 which is airtight except for the at least one perforation 304 which is provided for passage of air between the chamber 308 and the interior compartment 106 as hereinafter described. In this regard it may be noted that containment structure 302 is arranged to inhibit migration of particles from the interior compartment 106 into the chamber 308, but is also designed to facilitate passage of air between the chamber 308 and the interior compartment 106 as hereinafter described.

Figure 4:
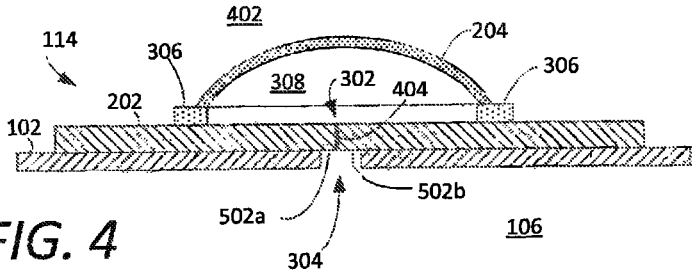
FIGS. 4-7 are a series of drawings showing cross-sectional views of the first embodiment vacuum seal indicator taken along line 4-4 in FIG. 2.

The resilient elastomer material forming the convex protrusion 204 is responsive to an air pressure differential as between the interior compartment 106 and an environment 402 external of the interior compartment. As such the convex protrusion is designed to collapse under a predetermined pressure differential condition. For example, the predetermined pressure differential can occur in the course of applying a vacuum pressure to the interior compartment as may occur in the course of a vacuum sealing procedure. The vacuum seal indicator in FIG. 4 is shown absent of any pressure differential. Accordingly, the convex protrusion is in its natural or outwardly biased state.

Figure 5:
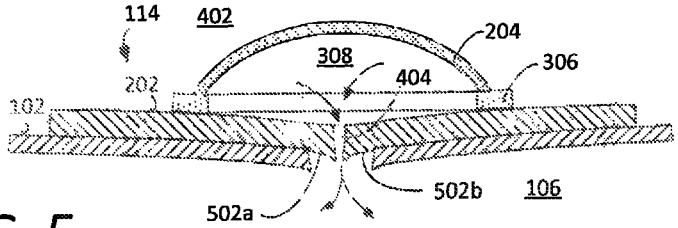
Figure 6:
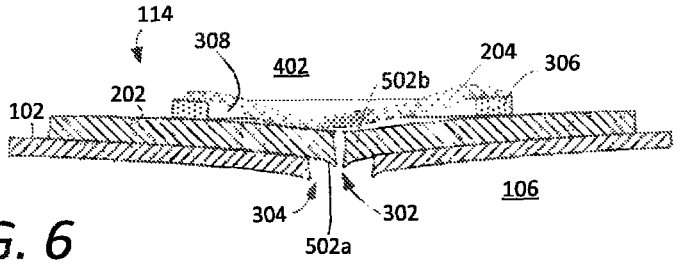
Figure 7:
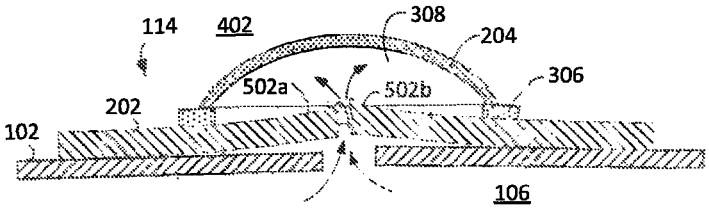

When an interior compartment 106 is subjected to vacuum pressure as would occur when the bag 100 is vacuum sealed, air pressure in chamber 308 is reduced relative to an external environment 402 as air drawn out of the interior compartment 106. This effect is shown in FIG. 5 in which the arrows show the movement of air out of the chamber 308. Eventually, the pressure difference between the external environment 402 and the internal compartment 106 will be sufficiently large such that the convex protrusion 204 will collapse as shown in FIG. 6. At this point, the opening 107 is sealed along the open end linear sheet edge 122 to maintain vacuum pressure within the bag. The vacuum pressure and seal can be formed using conventional vacuum bag sealing methods as are known in the art. After sealing, if the bag is unsealed for any reason (e.g. the bag is damaged or the bag is intentionally opened) there will be a loss of vacuum inside the bag. Accordingly, air will enter the interior compartment 106 and chamber 308 as shown by the arrows in FIG. 7. The air entering the interior compartment will equalize the pressure with the external environment and cause the convex protrusion 204 to revert to its natural state as shown in FIG. 7.

According to one aspect of the inventive arrangements, the convex protrusion 204 is formed of a translucent material of a first color and a surface of the chamber opposed from the convex protrusion (e.g. base 202) is a second color different from the first translucent color. The base can also be formed of a translucent material so that the second color can also be translucent. The use of translucent materials in this regard can allow for at least the partial transmission of light through the materials forming the convex protrusion and base. With the foregoing arrangement, a color of the convex protrusion will appear to change (when observed by a person from the bag exterior) in accordance with a color change function when the convex protrusion is caused to collapse as shown in FIG. 6. In particular, when the first and second colors are in close proximity or in close contact as shown in FIG. 6, the second color will be partially observable through the material of the convex protrusion. As a consequence, the observed color from the exterior of the bag will be a mixture of the first color and the second color, thereby producing an observed color change. For example, the base color could be blue and the convex protrusion could be red so that the mixture produces the color green. Of course, other color combinations could also be used for this purpose without limitation.

The flexible flaps 502 are arranged to at least partially open and close an aperture defined by the perforation 304 responsive to the air pressure differential. This function is illustrated in FIGS. 4-7 which show the opening and closing movements of the flaps 502. The flaps are not intended to be airtight, but function to substantially reduce migration of particles from the interior compartment 106 of the bag, to the chamber 308. Inhibiting such migration is important because particles of food entering into chamber 308 can interfere with the transition of the convex protrusion 204 from its natural state shown in FIG. 4 to its collapsed state shown in FIG. 6. For example, food items may enter into the chamber and prevent it from fully collapsing. Similarly, such particles can interfere with the transition of the convex protrusion from its collapsed state to its natural state. For example, particles of food can adhere to an interior surface of the convex protrusion, thereby inhibiting it from returning to its natural state when vacuum within the interior compartment has been lost. The function of the containment structure is important because it prevents food particles from causing false readings of the vacuum indicator.

Figure 8:
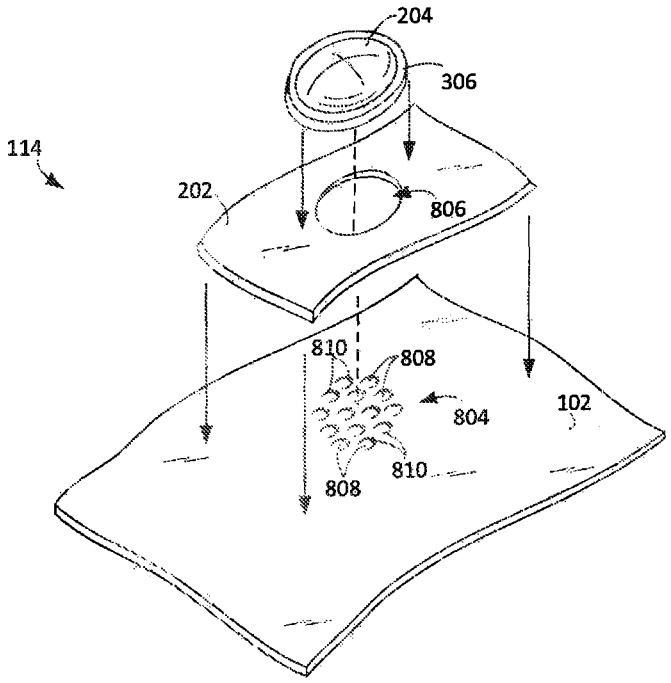
FIG. 8 is an exploded view showing a second embodiment of the vacuum seal indicator in FIG. 2.

Referring now to FIG. 8 there is shown an alternative embodiment of the vacuum indicator 114. In this embodiment, the containment structure 804 for inhibiting migration of particles into the chamber 308 is integrated into the first sheet 142 rather than being integrated into the base 202. In FIG. 8 the containment structure is comprised of at least one flexible panel in the form of a hinged flap 808. The flexible panel or hinged flap 808 is disposed within a periphery of each perforation 810. A portion of the perforation 808 is left uncut so as to form a hinge from a portion of the first sheet 102. The base structure includes an opening 806 for communicating flow of air between the perforations 810 and the chamber 308 internal of the convex protrusion 204. The opening 806 can be a simple aperture as shown, or can include other structures (e.g. a slit) to help inhibit a flow of particles from a bag interior compartment to the chamber. Alternatively, the base 202 can be eliminated entirely in this embodiment.

Figure 9:
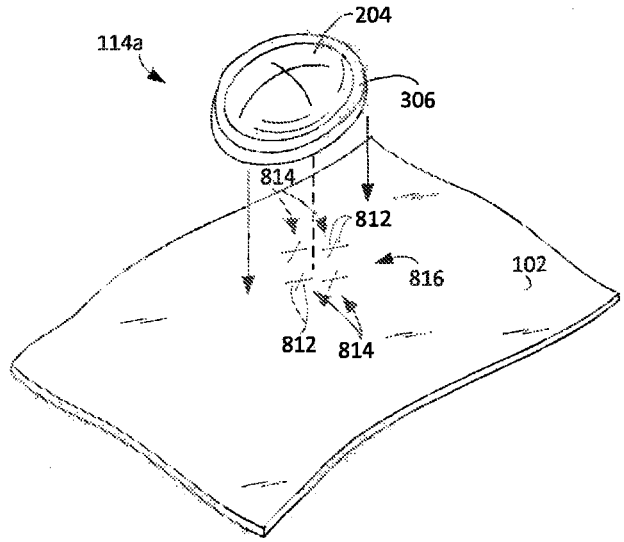
FIG. 9 is an exploded view showing a third embodiment of a vacuum seal indicator.

Referring now to FIG. 9 there is shown an alternative embodiment of a vacuum indicator **114*a* with a containment structure 816. In the vacuum indicator 114*a* one or more slits are formed in the first sheet 102 to form perforations 814. The perforations 814 can be similar to slit 404 shown in FIGS. 3-7. In such a scenario, each slit can define panels or flaps on opposing sides of the slit which are abutted to each other except when the flexible panels are flexed. In FIG. 9 one or more perforations 814 are formed by crossed slits formed in the first sheet 102. The slits define a plurality of hinged flaps 812. FIG. 9 also shows an alternative arrangement of a vacuum indicator 114*a* in which base 202 is omitted and the convex protrusion 204 is attached directly to the first sheet 102 using peripheral ring 306**. The peripheral ring can be attached using adhesive or thermal bonding means.

Figure 10:
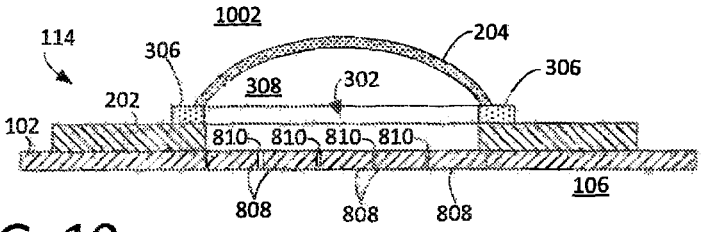
FIGS. 10-13 are a series of drawings that are useful for understanding the operation of the vacuum seal indicator in FIG. 8.

Referring now to FIGS. 10-13 there are shown a series of drawings comprising cross-sectional views of the alternative embodiment vacuum seal indicator in FIG. 8, taken along line 4-4 in FIG. 2. The convex protrusion 204 defines a chamber 308 which is airtight except for the at least one perforation 810 which is provided for passage of air between the chamber 308 and the interior compartment 106. The vacuum seal indicator in FIG. 10 is shown absent of any pressure differential. Accordingly, the convex protrusion is in its natural or outwardly biased state.

Figure 11:
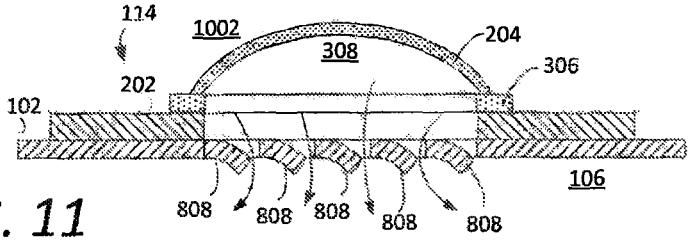
Figure 12:
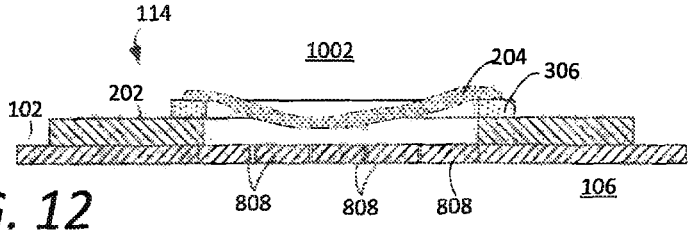
Figure 13:
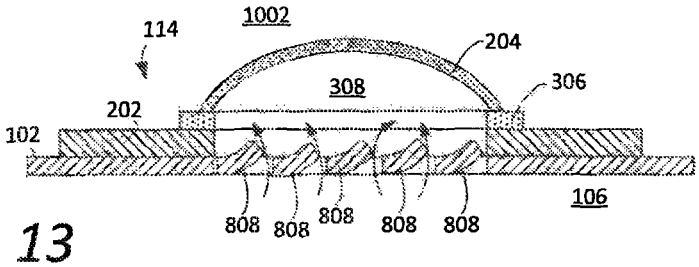

When an interior compartment 106 is subjected to vacuum pressure as would occur when the bag 100 is vacuum sealed, air pressure in chamber 308 is reduced relative to an external environment 1002 as air drawn out of the interior compartment. This effect is shown in FIG. 11 in which the arrows show the movement of air out of the chamber 308. Eventually, the pressure difference between the external environment 1002 and the internal compartment 106 will be sufficiently large such that the convex protrusion 204 will collapse as shown in FIG. 12. At this point, the opening 107 is sealed along the open end linear sheet edge 122 to maintain vacuum pressure within the bag. The vacuum pressure and seal can be formed using conventional vacuum bag sealing methods as are known in the art. After sealing, if the bag is unsealed for any reason (e.g. the bag is damaged or the bag is intentionally opened) there will be a loss of vacuum inside the bag. Accordingly, air will enter the interior compartment 106 and chamber 308 as shown by the arrows in FIG. 13. The air entering the interior compartment will equalize the pressure with the external environment 1002 and cause the convex protrusion 204 to revert to its natural state as shown in FIG. 13.

As may be observed in FIGS. 10-13, the hinged flaps 808 are arranged to at least partially open and close an aperture defined by the perforations 810 responsive to the air pressure differential. The flaps are not intended to be airtight, but function to substantially reduce migration of particles from the interior compartment 106 of the bag, to the chamber 308. Inhibiting such migration is important because particles of food entering into chamber 308 can interfere with the transition of the convex protrusion 204 from its natural state shown in FIG. 10 to its collapsed state shown in FIG. 12. For example, food items may enter into the chamber and prevent it from fully collapsing. Similarly, such particles can interfere with the transition of the convex protrusion from its collapsed state to its natural state. For example, particles of food can adhere to an interior surface of the convex protrusion, thereby inhibiting it from returning to its natural state when vacuum within the interior compartment has been lost. The function of the containment structure 804 is important because it prevents food particles from causing false readings of the vacuum indicator.

If more than one vacuum seal indicator is provided on a bag, the indictors are advantageously disposed in spaced relationship or distributed across the surface of the first sheet 102. Referring once again to FIG. 1 it can be observed that two or more vacuum seal indicators 114 can be disposed in one or more rows 124, 126. If more than one vacuum indicator is provided in each row, they can be disposed at a spacing $L_1$ and $L_2$ along the length of the bag 100. If two rows of indicators are used, the vacuum indicators 114 of each row can be spaced apart by a distance W. Each row is preferably spaced some distance apart from seals 108, 122 to ensure that each vacuum indicator is in communication with interior compartment 106 as hereinafter described. The vacuum seal indicators in each row are longitudinally offset along the length of the bag by an offset D. By distributing two or more vacuum indicators over the surface of the bag the vacuum indicators can separately indicate vacuum levels achieved in different parts of the bag. This can be advantageous in certain scenarios where food or folds in the material forming the bag cause one portion of the inner compartment to be partly isolated from other portions of the inner compartment.

Figure 14:
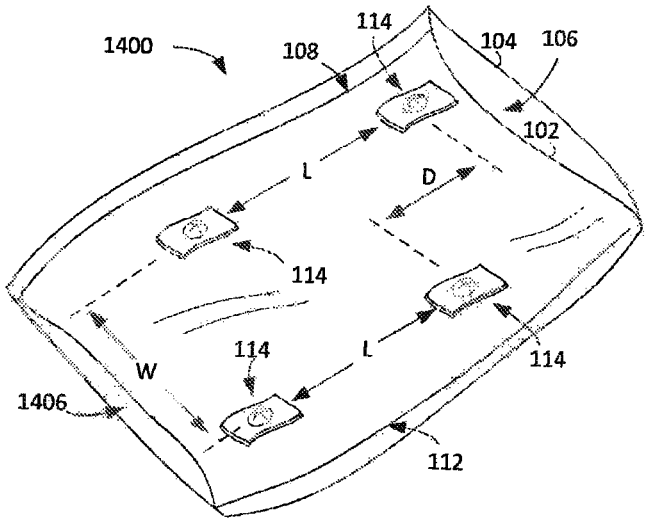
FIG. 14 is useful for understanding how the inventive arrangements can be implemented in a tubular configuration used to form a roll of bags.

FIG. 14 shows an arrangement of a tubular assembly 1400 which can be dispensed on a roll. The tubular assembly can be used to form one or more bags as described herein. For example, the bags can be formed by sealing an end 1406. In other respects, the tubular assembly shown in FIG. 14 is the same as bag 100 described herein.

Figure 15:
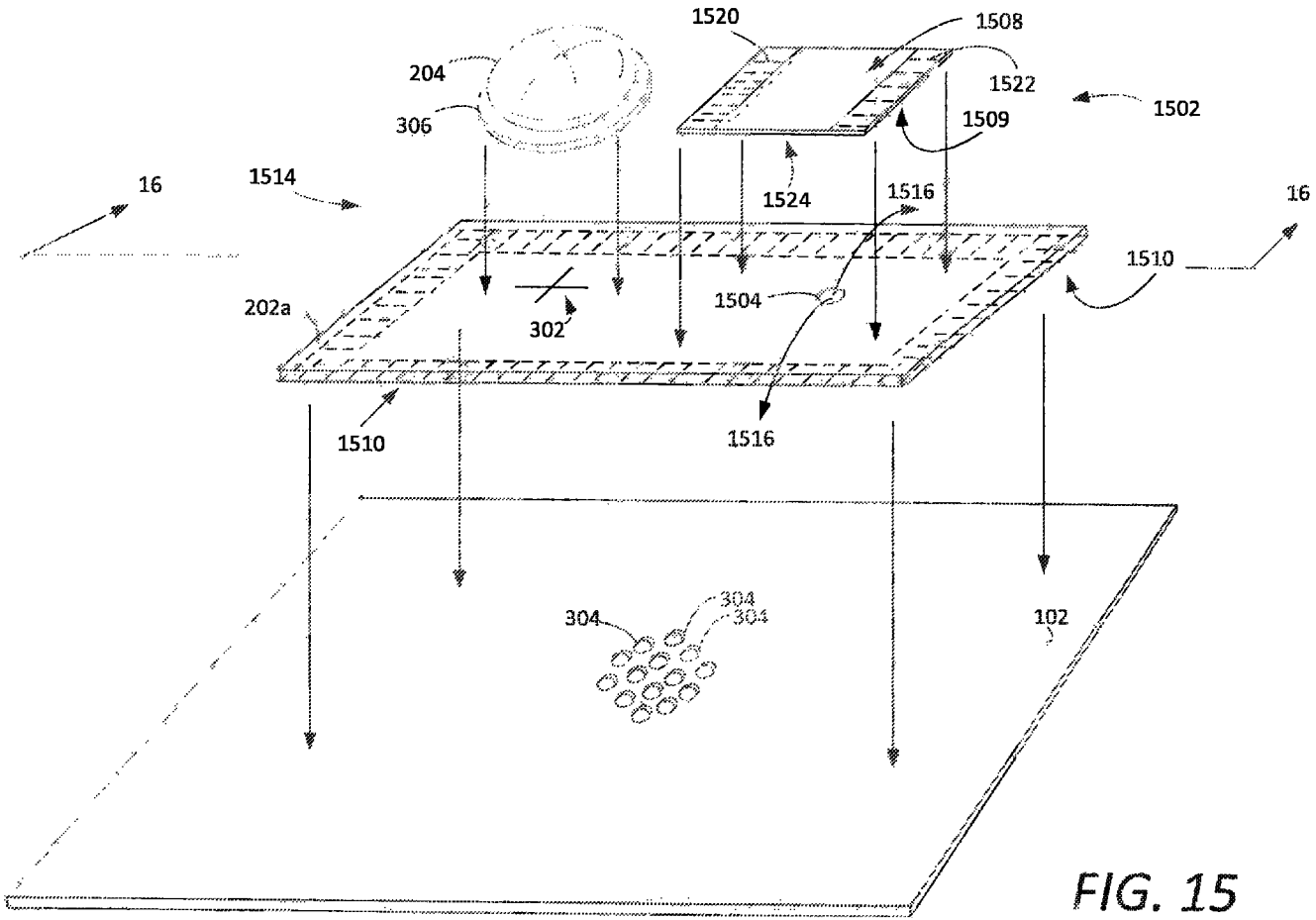
FIG. 15 is an exploded view which is useful for understanding how a vacuum indicator can be economically integrated with a simple reed valve in a sealable bag.
Figure 16:
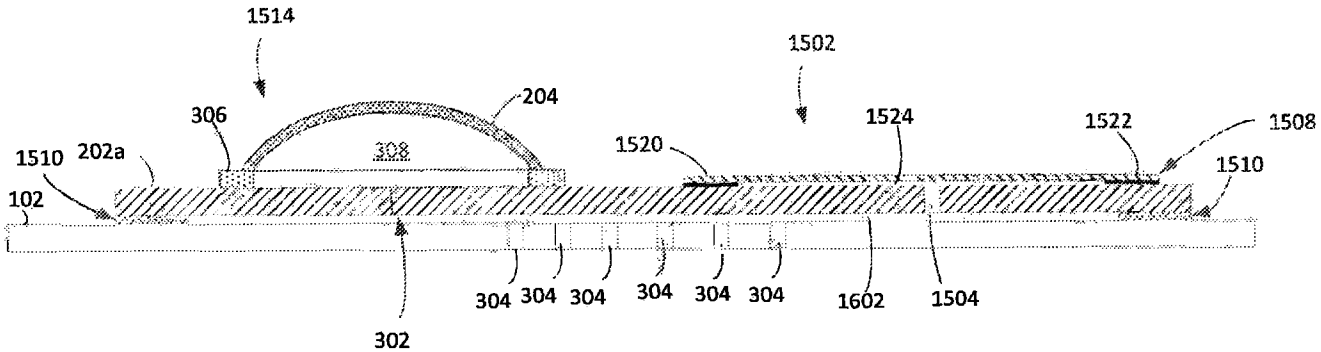
FIG. 16 is a cross-sectional view of a vacuum indicator and reed valve in accordance with the construction shown in FIG. 15.

Referring now to FIGS. 15 and 16 there is provided a vacuum indicator 1514 which is similar to the vacuum indicator 114 shown in FIGS. 3-7. Accordingly, the vacuum indicator 1514 includes convex protrusion 204 with peripheral ring 306 and a base 202*a* disposed on a first sheet 102 of a bag. In the example shown, the base has a containment structure 302 in the form of slit as previously described. Perforations 304 are provided in the first sheet 102 of the bag to allow the movement of air between chamber 308 and an interior compartment 106 of a bag. The perforation 304 can optionally include flaps (not shown) as previously described herein. The base 1510 is secured to the first sheet 102 around a peripheral edge of the base by means of an adhesive 1510 or thermal weld. This creates a plenum or air flow area 1602 as best seen in FIG. 16. The air flow area facilitates communication of air from an interior compartment of the bag, through the perforations 304 and containment structure 302, to chamber 308.

The vacuum indicator 1514 is integrated with a simple reed valve 1502 comprised of reed membrane 1508. Simple reed valves are sometimes used in conjunction with a hand operated vacuum pump to remove air from a bag after the bag has been sealed. Accordingly, it is advantageous to integrate a vacuum indicator with such a reed valve construction for reduced cost and added benefit to the consumer. The reed membrane 1508 is secured to the base 202*a* along opposing edges 1520, 1522 to define an air flow channel 1524. Adhesive 1509 or thermal welds can be used for such securing purposes. The air flow channel 1524 facilitates the flow of air 1516 from plenum 1602, through perforation 1504, and to an external environment outside the bag under certain conditions (e.g. when the reed membrane is exposed to a pressure differential). However, in the absence of such pressure differential, the reed membrane 1508 rests snugly against the base 202*a* and substantially seals the air flow channel 1524. The seal can be improved by a thin film layer of oil (not shown) disposed on the surfaces between the reed membrane and the base 202*a* in the area of the air flow channel 1524. From the foregoing it will be understood that the construction, of the vacuum indicator 1514 is integrated with the reed valve 1502 and utilizes several common components including base 202*a* and perforations 304.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

I claim:

1. A sealable plastic bag, comprising:

first and second sheets, each formed of a thin flexible plastic membrane;

each of the first and second sheets respectively having a substantially rectangular shape which defines four linear sheet edges;

first, second and third seals respectively formed along the length of three of the four linear sheet edges which attach the first sheet directly to the second sheet to partially enclose an interior compartment of a bag and define an opening to the interior compartment between the first and second plastic sheets along the fourth linear sheet edge;

at least one perforation formed in the first sheet spaced apart from the opening and each of the first, second and third seals;

an indicator of vacuum pressure disposed on said first sheet over the perforation, the indicator comprised of a resilient material which forms a resilient airtight convex protrusion on an external surface of the bag to define a chamber;

a containment structure associated with the perforation to inhibit migration of particles from the interior compartment into the chamber; and wherein said resilient material is responsive to an air pressure differential as between said interior compartment and an environment external of said interior compartment to collapse said convex protrusion under a predetermined pressure differential condition.

2. The sealable plastic bag according to claim 1, wherein the containment structure comprises at least one flexible panel adjacent to the at least one perforation arranged to at least partially open and close an aperture defined by the perforation responsive to the air pressure differential.

3. The sealable plastic bag according to claim 2, wherein the at least one flexible panel of the containment structure is formed from a portion of the first sheet disposed along a periphery of the perforation.

4. The sealable plastic bag according to claim 3, wherein the perforation is comprised of a slit in which opposing sides of the slit are abutted to each other except when the flexible panels are flexed.

5. The sealable plastic bag according to claim 4, wherein each perforation of said plurality of perforations defines an aperture in the first sheet which is less than 1/10 of a diameter defined by the convex protrusion.

6. The sealable plastic, bag according to claim 4, wherein said containment structure further comprises a plurality of flexible flaps formed of a portion of the first sheet and respectively extending from a peripheral edge of each said perforation to at least partially obstruct an opening defined by each said perforation.

7. The sealable plastic bag according to claim 1, wherein the at least one perforation comprises a plurality of perforations, and the containment structure is comprised of an integral mesh formed in the first sheet by the plurality of perforations.

8. The sealable plastic bag according to claim 1, wherein the containment structure is formed from a portion of the indicator disposed between the convex protrusion and first sheet.

9. The sealable plastic bag according to claim 1, wherein the convex protrusion is formed of a translucent material of a first color and wherein a surface of said chamber opposed from the convex protrusion, comprises a second translucent color different from the first translucent color, whereby a color of the convex protrusion appears to change in accordance with a color change function when the convex protrusion is caused to collapse.

10. The sealable plastic bag according to claim 1, wherein the indicator is attached to the first sheet by an adhesive material.

11. The sealable plastic bag according to claim 1, wherein the indicator is attached to the first sheet by a thermal weld.

12. The sealable plastic bag according to claim 1, wherein the containment structure is comprised of a planar member disposed on said first sheet.

13. The sealable plastic bag according to claim 12, further comprising a reed valve disposed on said planar member.

14. The sealable plastic bag according to claim 13, wherein the chamber and an air channel defined by the reed valve are both in fluid communication with a shared plenum disposed between an exterior surface of the first sheet and an interior surface of the planar member.

15. The sealable plastic bag according to claim 14, wherein the planar member is secured to the first sheet along a peripheral edge of the planar member to define the shared plenum.

16. The sealed bag according to claim 14 wherein said shared plenum is in fluid communication with the interior compartment of said bag through said at least one perforation.

17. A sealable plastic bag, comprising:

first and second sheets, each formed of a thin flexible plastic membrane;

each of the first and second sheets respectively having a substantially rectangular shape which defines four linear sheet edges;

first, second and third seals respectively formed along the length of three of the four linear sheet edges which attach the first sheet directly to the second sheet to partially enclose an interior compartment of a bag and define an opening to the interior compartment between the first and second plastic sheets along the fourth linear sheet edge;

at least one perforation formed in the first sheet spaced apart from the opening and each of the first, second and third seals;

an indicator of vacuum pressure disposed on said first sheet, the indicator comprised of a resilient material which forms a resilient convex protrusion on an external surface of the bag to define a chamber;

a containment structure associated with the perforation to inhibit migration of particles from the interior compartment into the chamber; and wherein said resilient material is responsive to an air pressure differential as between said interior compartment and an environment external of said interior compartment to collapse said convex protrusion under a predetermined pressure differential condition;

wherein the containment structure comprises at least one flexible panel adjacent to the at least one perforation arranged to at least partially open and close an aperture defined by the perforation responsive to the air pressure differential;

wherein the at least one flexible panel of the containment structure is formed from a portion of the first sheet disposed along a periphery of the perforation.

18. The sealable plastic bag according to claim 17, wherein the perforation is comprised of a slit in which opposing sides of the slit are abutted to each other except when the flexible panels are flexed.

19. The sealable plastic bag according to claim 17, wherein the at least one perforation comprises a plurality of perforations, and the containment structure is comprised of an integral mesh formed in the first sheet by the plurality of perforations.

20. The sealable plastic bag according to claim 19, wherein each perforation of said plurality of perforations defines an aperture in the first sheet which is less than 1/10 of a diameter defined by the convex protrusion.

* * * * *